US010308991B2

(12) United States Patent
Shih et al.

(10) Patent No.: US 10,308,991 B2
(45) Date of Patent: Jun. 4, 2019

(54) METHOD OF SEPARATING SACCHARIDES FROM AQUEOUS PRODUCT SOLUTION OF CELLULOSE HYDROLYSIS PROCESS

(71) Applicant: GREEN CELLULOSITY CORPORATION, Hsinchu (TW)

(72) Inventors: Ruey-Fu Shih, Hsinchu (TW); Cheng-Hao Liu, Hsinchu (TW); Chiang-Hsiung Tong, Hsinchu (TW); Hom-Ti Lee, Hsinchu (TW)

(73) Assignee: GREEN CELLULOSITY CORPORATION, Hsinchu (TW)

( * ) Notice: Subject to any disclaimer, the term of this patent is extended or adjusted under 35 U.S.C. 154(b) by 42 days.

(21) Appl. No.: 15/392,632

(22) Filed: Dec. 28, 2016

(65) Prior Publication Data

US 2017/0356061 A1 Dec. 14, 2017

(30) Foreign Application Priority Data

Jun. 13, 2016 (TW) ..... 105118356 A

(51) Int. Cl.
*C13K 1/04* (2006.01)

(52) U.S. Cl.
CPC ..... *C13K 1/04* (2013.01)

(58) Field of Classification Search
CPC ..... C13K 1/04
See application file for complete search history.

(56) References Cited

U.S. PATENT DOCUMENTS 4,018,620 A 4/1977 Penque
4,452,640 A 6/1984 Chen et al.
4,525,218 A * 6/1985 Chen ..... C13K 1/02 127/37
4,631,176 A * 12/1986 Kruesi ..... C01G 9/003 205/369
5,142,034 A * 8/1992 Bellas ..... C08B 3/24 536/58
2009/0187000 A1* 7/2009 Nakai ..... B29C 71/0072 527/300
2014/0331992 A1 11/2014 Tschentscher et al.
2014/0352688 A1 12/2014 Vallee et al.

FOREIGN PATENT DOCUMENTS

TW 201437222 10/2014
WO WO2009/047023 * 4/2009

* cited by examiner

*Primary Examiner* — Douglas B Call
(74) *Attorney, Agent, or Firm* — Ping Wang; Morris, Manning & Martin, LLP

(57) ABSTRACT

A method of separating a saccharide from an aqueous product solution of the cellulose hydrolysis process is provided. The aqueous product solution comprises a saccharide and a cellulose swelling agent. The cellulose swelling agent is zinc chloride, magnesium chloride or a combination thereof. The method comprises the following steps in the given order:

(a) adding a first tertiary amine and an optional first organic solvent to the aqueous product solution to provide a mixture;
(b) performing a solid-liquid separation to obtain a solution from the mixture; and
(c) performing a liquid-liquid extraction by adding a second tertiary amine and a second organic solvent to the solution, and then removing the organic phase and collecting the aqueous phase, wherein the first tertiary amine and the second tertiary amine are the same or different, and the first organic solvent and the second organic solvent are the same or different.

15 Claims, 1 Drawing Sheet

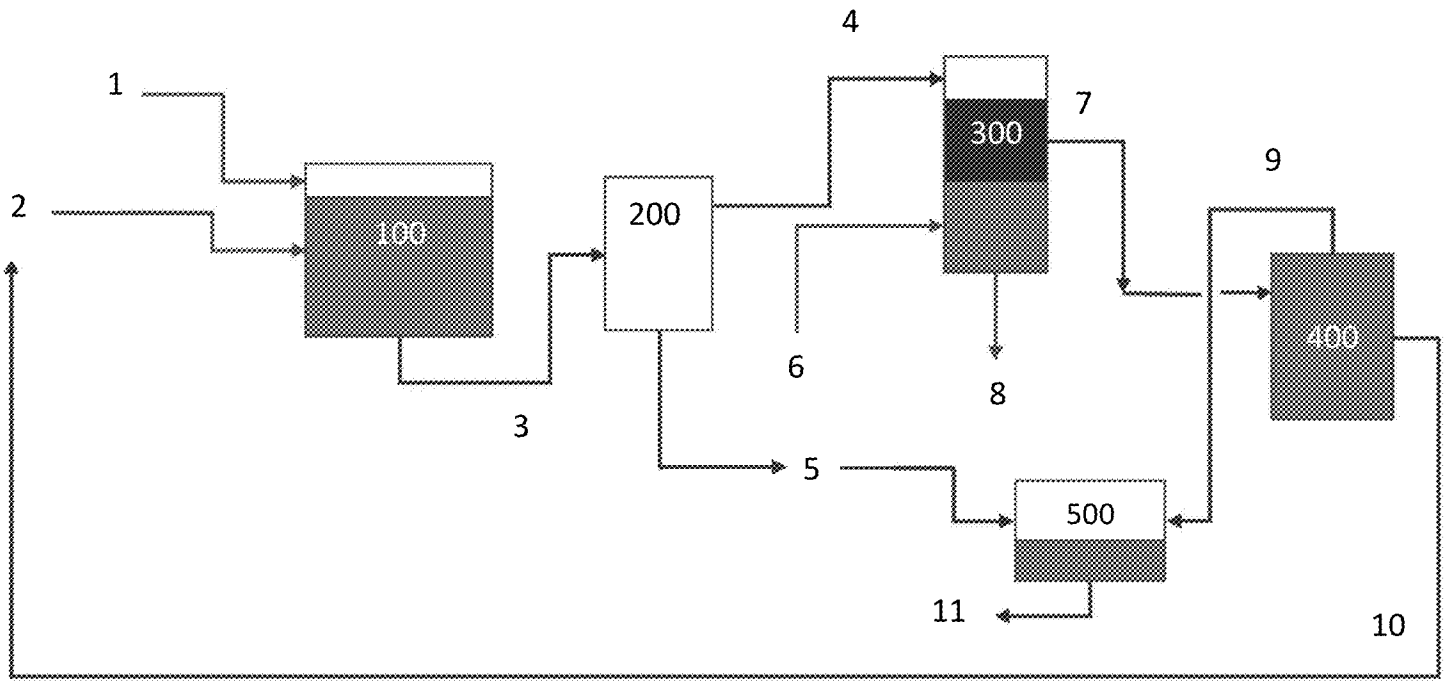
1
2
100
3
200
4
300
5
6
7
8
400
9
500
10
11

METHOD OF SEPARATING SACCHARIDES FROM AQUEOUS PRODUCT SOLUTION OF CELLULOSE HYDROLYSIS PROCESS

CLAIM FOR PRIORITY

This application claims the benefit of Taiwan Patent Application No. 105118356, filed Jun. 13, 2016, the subject matters of which are incorporated herein by reference.

BACKGROUND OF THE INVENTION

Field of the Invention

The present invention provides a method of separating a saccharide from an aqueous product solution of the cellulose hydrolysis process, especially a method of separating a saccharide from an aqueous product solution of the cellulose hydrolysis process using a cellulose swelling agent.

Descriptions of the Related Art

Due to the depletion of petroleum reserves, many studies are currently being conducted to develop new energy sources by fermenting saccharides in biomass such as corn stover, corn on the cob, straw, and corn fiber into alcohols. Cellulose, which comprises the majority of biomass, is a polymer of glucose. The cellulose can be hydrolyzed to form monosaccharides or oligosaccharides facilitates, and then fermented into alcohols.

Generally the hydrolysis of cellulose is carried out by mixing the cellulose with acidic aqueous solution and adding a suitable cellulose swelling agent in the obtained mixture. The cellulose swelling agent will facilitate the dissolution of the cellulose in water and increase the hydrolyzing rate of the cellulose. Common cellulose swelling agents include metal chlorides such as zinc chloride, calcium chloride, and magnesium chloride. After the cellulose is hydrolyzed into monosaccharides or oligosaccharides, the saccharides in the aqueous product solution are separated for subsequent processes.

One of the problems in the process of hydrolyzing cellulose into monosaccharides or oligosaccharides using the cellulose swelling agent is the separation of the cellulose swelling agent from the aqueous product solution. Several methods have been proposed for the separation. For example, U.S. Pat. No. 4,452,640 mentions that glucose (the cellulose hydrolysis product) and zinc chloride (the cellulose swelling agent) are difficult to separate, and suggests using ion exclusion with an anion exchanger to separate glucose and zinc chloride from the aqueous product solution. U.S. Pat. No. 4,018,620 employs calcium chloride as a cellulose swelling agent, and the cellulose swelling agent is separated by crystalizing out calcium chloride as a hexahydrate or by adding sulfuric acid into the aqueous product solution to form calcium sulfate precipitate. U.S. Pub. No. 2014/0331992 A1 suggests adding an organic solvent into the aqueous product solution as an anti-solvent to precipitate and separate the saccharides.

However, the conventional methods of separating saccharides from the aqueous product solution require a large quantity of solvent and therefore produce lots of waste liquid, which make the replacement or regeneration of the ion exchange resin more frequent, thereby complicating the process. Therefore, there is a need for a method that can effectively separate saccharides from an aqueous product solution of the cellulose hydrolysis process, save energy, and reduce the amount of waste liquid. In view of this, the present invention provides a method of separating a saccharide from an aqueous product solution of the cellulose hydrolysis process, which can efficiently separate the saccharides from the aqueous product solution and recover the materials added during the process. All of these advantages make the method of the present invention economical.

SUMMARY OF THE INVENTION

An objective of the present invention is to provide a method of separating a saccharide from an aqueous product solution of cellulose hydrolysis process, wherein the aqueous product solution comprises a saccharide and a cellulose swelling agent. The cellulose swelling agent is zinc chloride, magnesium chloride or a combination thereof. The method comprises the following steps in the given order:

(a) adding a first tertiary amine and an optional first organic solvent to the aqueous product solution to provide a mixture;

(b) performing a solid-liquid separation to obtain a solution from the mixture; and (c) performing a liquid-liquid extraction by adding a second tertiary amine and a second organic solvent to the solution, and then removing the organic phase and collecting the aqueous phase, wherein the first tertiary amine and the second tertiary amine are the same or different, and the first organic solvent and the second organic solvent are the same or different.

To render the above objectives, technical features and advantages of the present invention more apparent, the present invention will be described in detail with reference to some embodiments hereinafter.

BRIEF DESCRIPTION OF THE DRAWINGS

FIG. 1 is a schematic diagram of an embodiment of the method according to the present invention.

DESCRIPTION OF THE PREFERRED EMBODIMENT

Hereinafter, some embodiments of the present invention will be described in detail. However, without departing from the spirit of the present invention, the present invention may be embodied in various embodiments and should not be limited to the embodiments described in the specification. Furthermore, unless it is additionally explained, the expressions "a," "the," or the like recited in the specification of the present invention (especially in the claims) should include both the singular and the plural forms.

The present invention provides a method of separating a saccharide from an aqueous product solution of the cellulose hydrolysis process, wherein the aqueous product solution comprises a saccharide and a cellulose swelling agent. The cellulose swelling agent is zinc chloride, magnesium chloride or a combination thereof. The method comprises the following steps in the given order:

(a) adding a first tertiary amine and an optional first organic solvent to the aqueous product solution to provide a mixture;

(b) performing a solid-liquid separation to obtain a solution from the mixture; and (c) performing a liquid-liquid extraction by adding a second tertiary amine and a second organic solvent to the solution, and then removing the organic phase and collecting the aqueous phase, wherein the first tertiary amine and the second tertiary amine are the same or different, and the first organic solvent and the second organic solvent are the same or different.

A general cellulose hydrolysis process involves the mixing and reaction of cellulose, an acid as a catalyst, a cellulose swelling agent, and water. In the cellulose hydrolysis process, the cellulose is hydrolyzed into monosaccharides or oligosaccharides by an acid catalyzed reaction. The aqueous product solution of the cellulose hydrolysis process contains zinc chloride and/or magnesium chloride as a cellulose swelling agent as the starting material, and separates the saccharides and the cellulose swelling agent (zinc chloride and/or magnesium chloride) in the aqueous product solution of the cellulose hydrolysis process through a simple operation.

In the method of the present invention, the saccharide in the aqueous product solution of the cellulose hydrolysis process is generated from the hydrolysis of cellulose. The saccharide may be a monosaccharide, a disaccharide, or an oligosaccharide. Examples of the saccharide include but are not limited to glucose, fructose, xylose, and mixtures thereof. Generally, the aqueous product solution of cellulose hydrolysis process comprises 0.1 to 40 wt % of saccharides, 0.1 to 40 wt % of cellulose swelling agent, and water as the remainder. However, the method of the present invention is also applicable to an aqueous product solution of cellulose hydrolysis process with a composition ratio different from the above.

In step (a) of the method of the present invention, a first tertiary amine and an optional first organic solvent are added to the aqueous product solution of cellulose hydrolysis process to provide a mixture. The first tertiary amine and the optional first organic solvent may be added in any order, and the order of the addition is not critical to the present invention. For example, if the first organic solvent is used, the first tertiary amine and the first organic solvent may be mixed before mixing them with the aqueous product solution of the cellulose hydrolysis process. Alternatively, either the first tertiary amine or the first organic solvent may be mixed with the aqueous product solution of the cellulose swelling agent in advance, then the other may be mixed with the obtained mixture. However, the present invention is not limited thereto. The mixing method is not particularly limited. Any methods known in the art and/or mixing tools may be applied to evenly mix the aqueous product solution, the first tertiary amine, and the optional first organic solvent.

The first tertiary amine added in step (a) will react with the zinc chloride and/or magnesium chloride (referred to as "metal chlorides" hereinafter) as the cellulose swelling agent to generate a first tertiary ammonium chloride and corresponding metal hydroxides (precipitates of zinc hydroxide and/or magnesium hydroxide). The first tertiary ammonium chloride is dissolved in the aqueous product solution and the metal hydroxides are solid.

In step (b) of the method of the present invention, a solid-liquid separation is performed on the mixture obtained from step (a) to remove the solid from the mixture and obtain a solution. Any solid-liquid separation methods known in the art can be applied to remove the solid component. Examples of the solid-liquid separation methods include centrifugation, filtration, and decantation.

To provide a solution comprising only a small amount of metal chlorides or be substantially free of metal chlorides, step (a) and/or step (b) may be repeatedly performed to make the metal chlorides in the aqueous product solution of cellulose hydrolysis process substantially react into a metal hydroxides precipitate so that the metal hydroxides precipitate be removed.

In step (c) of the method of the present invention, a liquid-liquid extraction is performed by adding a second tertiary amine and a second organic solvent to the solution obtained from step (b), and then removing the organic phase and collecting the aqueous phase. The second tertiary amine and the first tertiary amine in the step (a) may be the same or different, and the second organic solvent and the first organic solvent in the step (a) (if applied) may be the same or different.

In the method of the present invention, the first tertiary ammonium chloride formed in step (a) will be extracted into the organic layer through the liquid-liquid extraction of step (c) while the saccharides will remain in the aqueous phase (i.e. water layer). The present invention can efficiently obtain the saccharide product in the aqueous product solution of the cellulose hydrolysis process by virtue of the reaction, separation and extraction of steps (a) to (c) without using complex apparatuses or operations, and therefore can provide the benefit of saving energy and cost.

In the method of the present invention, the operation conditions of steps (a) to (c) are not particularly limited and can be determined depending on the needs by persons skilled in the art. For example, steps (a) to (c) may be performed under a temperature ranging from normal temperature to 60° C. and a pressure ranging from 1 to 2 atm, but the present invention is not limited thereto.

According to the method of the present invention, it is preferred that the tertiary amine applied in steps (a) and (c) are immiscible with water, wherein the alkyl groups of the tertiary amine may independently be a linear alkyl group, a branched alkyl group, or a cycloalkyl group. More preferably, the first tertiary amine and the second tertiary amine of the present invention are independently represented by a formula of $NR_1R_2R_3$, wherein each of $R_1$, $R_2$, and $R_3$ is independently C4-C10 alkyl.

For example, the first tertiary amine and the second tertiary amine may be independently selected from the group consisting of N-methyldicyclohexylamine, tributylamine, tripentylamine, tri-n-octylamine, tri-isooctylamine, and combinations thereof, but are not limited thereto. As illustrated by the accompanying examples, in some embodiments of the present invention, the first tertiary amine and the second tertiary amine are independently selected from tributylamine, tripentylamine, tri-n-octylamine, and tri-isooctylamine.

According to the method of the present invention, the optional first organic solvent in step (a) and the second organic solvent in step (c) can be any inert organic solvents that do not react with saccharides, metal chlorides and metal hydroxides, the first tertiary amine and the second tertiary amine, or water. Preferably, the first organic solvent and second organic solvent are independently selected from the group consisting of primary alcohols, ketones, C6 or heavier alkanes, chloroalkanes, benzene and its derivatives, and combinations thereof. As illustrated by the accompanying examples, in some embodiments of the present invention, the first organic solvent and the second organic solvent are independently selected from the group consisting of n-butanol, n-octanol, methyl isopropyl ketone (MIPK), base oil, and combinations thereof.

Preferably, the first organic solvent and the second organic solvent are independently a primary alcohol selected from the group consisting of n-butanol, n-pentanol, n-hexanol, cyclohexanol, n-heptanol, n-octanol, the isomers thereof, and combinations thereof. Examples of the isomers of the primary alcohols include but are not limited to isobutanol, sec-butanol, tert-butanol, 2-pentanol, 3-pentanol, 2-methylbutanol, 3-methylbutanol, 2-methyl-2-butanol, 3-methyl-2-butanol, 2,2-dimethylpropanol, isohexanol, isoheptanol, and isooctanol.

Preferably, the first organic solvent and the second organic solvent may also be independently a ketone selected from the group consisting of butanone, pentanone, hexanone, cyclohexanone, isomers thereof, and combinations thereof. Examples of the isomers of the ketones include but are not limited to 2-pentanone, 3-pentanone, 3-methylbutanone, 2-hexanone, 3-hexanone, methyl isobutyl ketone, 3-methyl-2-pentanone, methyl tert-butyl ketone, and ethyl isobutyl ketone.

Preferably, the first organic solvent and the second organic solvent may be independently selected from the group consisting of chloromethane, dichloromethane, trichloromethane, 1,1-dichloroethane, 1,2-dichloroethane, and combinations thereof.

Persons skilled in the art may adjust the ratio of the tertiary amine to the organic solvent and the amounts of the tertiary amine and organic solvent in steps (a) and (c), depending on, for example, the amounts of the aqueous product solution of cellulose hydrolysis process and the cellulose swelling agent therein. For example, in step (a), the amount of the first organic solvent may be 0 to 5 parts by weight, preferably 0 to 3.5 parts by weight per part by weight of the first tertiary amine; and in step (c), the amount of the second tertiary amine may be 0.1 to 10 parts by weight per part by weight of the second organic solvent.

Optionally, step (c) may be repeatedly performed. Specifically, the liquid-liquid extraction may be repeatedly carried out by adding the second tertiary amine and the second organic solvent to the aqueous phase obtained in step (c) to remove the first tertiary ammonium chloride generated in step (a) as much as possible and provide an aqueous phase without or substantially without the first tertiary ammonium chloride.

The method of the present invention may further comprise at least one of the following steps to recover or recycle the materials:

(d) heating the organic phase removed in step (c) to recycle the first tertiary amine and the second tertiary amine and obtain hydrochloride; and (e) washing the solid fraction separated in step (b) with water, and mixing the washed solid fraction with an aqueous solution of hydrochloride to recycle the cellulose swelling agent (zinc chloride and/or magnesium chloride).

In step (d), the tertiary ammonium chloride in the organic phase removed in the step (c) is decomposed into tertiary amine and hydrochloride by heating the organic phase obtained from step (c). The suitable temperature for performing step (d) depends on the species of tertiary amine, tertiary ammonium chloride, and organic solvent contained in the organic phase obtained from step (c).

The heating treatment in step (d) may be conducted by any general heating methods in the art. For example, step (d) may be performed by using an evaporator to evaporate the organic phase, or by using a distiller to distill the organic phase. However, the present invention is not limited thereto. In the case of using a distiller, hydrogen chloride gas can be collected from the top of the distiller, and the tertiary amine can be collected from the bottom of the distiller and recycled to step (a) and/or step (c). Therefore, the first tertiary ammonium chloride and the second tertiary ammonium chloride used in steps (a) and (c) and optionally, the first organic solvent and the second organic solvent can be recovered in the method of the present invention.

In step (e), the solid fraction separated in step (b) is washed with water and the washed solid fraction is mixed with an aqueous solution of hydrochloride to recycle the cellulose swelling agent. The solid fraction separated in step (b) is substantially made of metal hydroxide precipitates generated from the metal ions of the cellulose swelling agent used in the cellulose hydrolysis process. The solid fraction reacts with the aqueous solution of hydrochloride in step (e) to form corresponding metal chlorides. Therefore, the zinc chloride and/or magnesium chloride can be recycled.

The method of the present invention may further comprise a step of removing the organic phase from the mixture before step (b), or a step of removing the organic phase from the solution before step (c). As a result of the organic phase removing step, the operation volume in step (c) can be reduced and therefore, step (c) can be performed with a small extraction apparatus.

An embodiment according to the method of the present invention is described below with reference to FIG. 1. As shown in FIG. 1, the aqueous product solution of the cellulose hydrolysis process 1 comprising a saccharide, a cellulose swelling agent, and water and the extraction agent 2 comprising a first tertiary amine are fed into the reactor 100, mixed and reacted to provide a mixture 3. The mixture 3 is fed to a filter 200 to perform a solid-liquid separation to obtain a solution 4 and a solid 5, wherein the solution 4 contains the saccharide, the first tertiary ammonium chloride, unreacted first tertiary amine, and water, and the solid 5 contains metal hydroxides generated from the reaction of the metal ions of the cellulose swelling agent. The solution 4 and an extraction agent 6 (not shown) comprising a second tertiary amine and a second organic solvent are fed to an extractor 300 to perform the liquid-liquid extraction, then obtain organic phase 7 and aqueous phase 8, wherein the first tertiary ammonium chloride is extracted into the organic phase 7 and the aqueous phase 8 comprises the saccharide and water. In this way, the saccharide can be separated from the aqueous product solution of the cellulose hydrolysis process.

The organic phase 7 may further be heated by a heater 400 to decompose the tertiary ammonium chloride and obtain hydrochloride 9 and tertiary amine 10, and the tertiary amine 10 may optionally be recycled and used in the extraction agent 2 and/or extraction agent 6. Hydrochloride 9 may also be recycled and sent to the reactor 500 to react with the metal hydroxides in the solid 5 to produce metal chlorides 11 and water. The metal chlorides 11 may be recycled and used in the cellulose hydrolysis process as a cellulose swelling agent.

According to the method of the present invention, the solid precipitates can be separated from the aqueous product solution of cellulose hydrolysis process to provide a solution free of or substantially free of metal ions without using complex apparatuses or operations; and the tertiary ammonium chloride can be effectively extracted into the organic phase to separate the saccharides from the aqueous product solution through the liquid-liquid extraction using the second tertiary amine and the second organic solvent. Furthermore, the material used in the method of the present invention, including the tertiary amine and the organic solvent, and even the cellulose swelling agent of the cellulose hydrolysis process, can be optionally recycled. The method of the present invention is thus, more environment friendly and economical.

EXAMPLES

The present invention will be further illustrated by the following embodiments, wherein the measuring methods are respectively as follows.

Concentration of metal ions: the concentration of metal ions in the sample is measured by using an atomic absorption spectrometer (AA).

Concentration of tertiary ammonium chloride: the sample is titrated with 0.1M standard solution of sodium hydroxide and the titration end point is set to be the equivalence point. The equivalent of tertiary ammonium chloride is calculated accordingly.

Concentration of saccharides: the concentration of saccharides in the aqueous sample is measured by the HPLC method.

Weight of the solid precipitate: the solid precipitate is dried in a 60° C. vacuum oven to constant weight to estimate the proportion of metal ions that reacted and formed the solid. The result is a reference when determining the metal ion removal rate.

In the following examples, the base oil used is obtained from Formosa Petrochemical Corporation, which is a mixture of C6 or heavier alkanes and has a boiling point over 214° C. under 10 mmHg.

[Removing Metal Ions from a Mixture of Saccharides and Cellulose Swelling Agent]

Example 1

A saccharide mixture aqueous solution containing 15.8 wt % glucose and 19.4 wt % $ZnCl_2$ was prepared to simulate the aqueous product solution of the cellulose hydrolysis process. According to the ratio shown in Table 1, trioctylamine (TOA) or triisooctylamine (TIOA) as the first tertiary amine, and butanol and base oil both as the first organic solvent were added to the saccharide mixture aqueous solution to provide a mixture solution that was stirred until the amount of precipitate no longer increased to obtain a mixture. The mixture was filtered with a filter paper using a Buchner funnel to obtain a filtrate and a filter cake. The filtrate was allowed to stand and stratify into layers. The weight of each layer was measured. The water layer (aqueous phase in the filtrate) was collected and weighed. A portion of this sample was retained for the following examples. The aqueous phase was then nitrated with 70% nitric acid, and the weight percentage of $Zn^{2+}$ was measured to calculate the remaining amount of $Zn^{2+}$ in the aqueous phase. The remaining amount of $Zn^{2-}$ was compared with the amount of $Zn^{2+}$ in the initial mixture aqueous solution to calculate the removal rate of zinc ion. The filter cake was washed by butanol and then washed by water twice. The washed filter cake was dried using vacuum drying and further dried in a 60° C. vacuum oven. The weight of the filter cake was measured for reference. The results are shown in Table 1.

TABLE 1

| Example | Tertiary amine (g) | | Butanol (g) | Base oil (g) | Saccharide mixture aqueous solution (g) | Dried weight of filter cake (g) | Weight of aqueous phase (g) | Concentration of zinc ion remaining in the aqueous phase (wt %) | Removal rate of zinc ion (%) |
|---|---|---|---|---|---|---|---|---|---|
| 1-1 | TIOA | 360.16 | 200.24 | 200.43 | 278.7 | 38.21 | 153.99 | 0.95 | 94.3 |
| 1-2 | TOA | 360.12 | 100.23 | 200.17 | 278.7 | 30.61 | 135.72 | 0.78 | 95.9 |

Example 2

The procedures in Example 1 were repeated except that a saccharide mixture aqueous solution containing 18.46 wt % glucose and 22.7 wt % $ZnCl_2$ was used. The amounts of the relevant reagents and the results of the relevant measurements are shown in Table 2.

TABLE 2

| Example | Trioctylamine (TOA) (g) | Butanol (g) | Base oil (g) | Saccharide mixture aqueous solution (g) | Dried weight of filter cake (g) | Weight of aqueous phase (g) | Concentration of zinc ion remaining in the aqueous phase (wt %) | Removal rate of zinc ion (%) |
|---|---|---|---|---|---|---|---|---|
| 2-1 | 280.13 | 100.27 | 560.05 | 238.7 | 30.95 | 111.29 | 1.64 | 93 |
| 2-2 | 280.47 | 100.20 | 840.18 | 238.7 | 29.12 | 146.01 | 1.95 | 89.1 |
| 2-3 | 360.04 | 100.02 | 0 | 238.7 | 37.45 | 86.21 | 0.56 | 98.1 |

Example 3

The procedures in Example 1 were repeated except that a saccharide mixture aqueous solution containing 22.04 wt % glucose and 21.6 wt % $ZnCl_2$ was used and the precipitation was performed at 60° C. The amounts of the relevant reagents and the results of the relevant measurements are shown in Table 3.

TABLE 3

| Example | Trioctylamine (TOA) (g) | Butanol (g) | Base oil (g) | Saccharide mixture aqueous solution (g) | Dried weight of filter cake (g) | Weight of aqueous phase (g) | Concentration of zinc ion remaining in the aqueous phase (wt %) | Removal rate of zinc ion (%) |
|---|---|---|---|---|---|---|---|---|
| 3-1 | 360.94 | 100.15 | 200.99 | 249.9 | 36.01 | 58.11 | 0.79 | 98.2 |

The results in Examples 1 to 3 show that the method of the present invention can remove the metal ion of the cellulose swelling agent from the mixture solution of saccharides and cellulose with a high removal rate by adding a first tertiary amine and an optional first organic solvent to the mixture solution.

[Distribution Coefficient of Tertiary Ammonium Chloride in Organic Phase and Aqueous Phase]

Example 4

According to the ratio shown in Table 4, tributylamine (TBA) as the first tertiary amine and butanol and/or n-octanol both as the first organic solvent were added to an aqueous solution containing 30 wt % $ZnCl_2$ to provide a mixture solution. The mixture solution was stirred until the amount of precipitate no longer increased to obtain a mixture. The mixture was filtered with a filter paper using a Buchner funnel to obtain a filtrate and a filter cake. The filter cake was washed by butanol and then washed by water twice. The washed filter cake was dried using vacuum drying and further dried in a 60° C. vacuum oven. The dried weight of the filter cake was measured and the solid component thereof was analyzed. The amount of zinc contained therein was used to calculate the $ZnCl_2$ removal rate. The filtrate and washed liquid were combined and allowed to stand and stratify into layers (organic phase and aqueous phase). Afterwards, the organic phase and the aqueous phase were titrated with 0.1M standard solution of sodium hydroxide to determine the concentration of tributylammonium chloride (TBAH-Cl) in both phases and calculate the distribution coefficient. The results are shown in Table 4.

TABLE 4

| Example | Composition of organic extraction agent: Tertiary amine/first organic solvent | Composition of organic extraction agent: Weight ratio | Organic extraction agent/$ZnCl_2$ solution Weight ratio | $ZnCl_2$ removal rate (%) | Concentration of TBAH-Cl after removing the precipitate (M): Organic phase | Concentration of TBAH-Cl after removing the precipitate (M): Aqueous phase | TBAH-Cl distribution coefficient |
|---|---|---|---|---|---|---|---|
| 4-1 | TBA/n-butanol | 2:1 | 3:1 | 96 | 1.32 | 0.68 | 1.9 |
| 4-2 | TBA/n-butanol | 3:1 | 2.67:1 | 96 | 1.58 | 0.72 | 2.2 |
| 4-3 | TBA/n-butanol | 2:1 | 2:1 | 98 | 1.04 | 0.62 | 1.7 |
| 4-4 | TBA/n-butanol | 1:1 | 4:1 | 72 | 0.464 | 0.436 | 1.1 |
| 4-5 | TBA/[n-butanol/n-octanol = 1:1] | 1:1 | 4:1 | 97 | 0.565 | 0.496 | 1.1 |
| 4-6 | TBA/[n-butanol/n-octanol = 1:1] | 1:1 | 2:1 | 86 | 1.091 | 0.568 | 1.9 |

Example 5

The procedures of Example 4 were repeated except that trioctylamine (TOA) was used as the first tertiary amine and methyl isopropyl ketone (MIPK) was used as the first organic solvent. The filter cake was washed by MIPK and acetone and then washed by water twice. The amounts of the relevant reagents and the results of the relevant measurements are shown in Table 5.

TABLE 5

| Example | Composition of organic extraction agent: Tertiary amine/first organic solvent | Weight ratio | Organic extraction agent/$ZnCl_2$ solution weight ratio | $ZnCl_2$ removal rate (%) | Concentration of TBAH-Cl after removing the precipitate (M): Organic phase | Aqueous phase | TBAH-Cl distribution coefficient |
|---|---|---|---|---|---|---|---|
| 5-1 | TOA/MIPK | 3.5:1 | 3:1 | 62 | 1.79 | 0.17 | 10.5 |

Example 6

The procedures of Example 4 were repeated except that a saccharide mixture aqueous solution containing 10 wt % glucose and 30 wt % $ZnCl_2$ was used and tributylamine (TBA) as the first tertiary amine and butanol as the first organic solvent were used. The amounts of the relevant reagents and the results of the relevant measurements are shown in Table 6.

TABLE 6

| Example | Composition of organic extraction agent: Tertiary amine/first organic solvent | Weight ratio | Organic extraction agent/saccharide mixture solution weight ratio | $ZnCl_2$ removal rate (%) | Concentration of TBAH-Cl after removing the precipitate (M): Organic phase | Aqueous phase | TBAH-Cl distribution coefficient |
|---|---|---|---|---|---|---|---|
| 6-1 | TBA/n-butanol | 2:1 | 2:1 | 85 | 0.96 | 0.52 | 1.8 |

Example 7

The procedures of Example 4 were repeated except that an aqueous solution containing 30% $MgCl_2$ was used, tripentylamine (TPA) as the first tertiary amine was used. The first organic solvent was not used, and the filter cake was washed by MIPK and acetone and then washed by water twice. The amounts of the relevant reagents and the results of the relevant measurements are shown in Table 7.

TABLE 7

| Example | Composition of organic extraction agent: Tertiary amine | Organic extraction agent/$MgCl_2$ solution Weight ratio | $MgCl_2$ removal rate (%) | Concentration of TBAH-Cl after removing the precipitate (M): Organic phase | Aqueous phase | TPAH-Cl distribution coefficient |
|---|---|---|---|---|---|---|
| 7-1 | TPA | 2.36:1 | 95 | 0.005 | 0.648 | 0.008 |

The results in Examples 4 to 7 show that after the metal ions of the cellulose swelling agent were removed with a high removal rate, the tertiary ammonium chloride was distributed in both the organic phase and the aqueous phase. Therefore, step (c) of the method of the present invention must be performed to remove the tertiary ammonium chloride in the aqueous phase to obtain a saccharide aqueous solution with high purity.

[Removing Tertiary Ammonium Chloride from Aqueous Phase]

Example 8

The aqueous phase sample obtained from Example 1-1 and containing triisooctyl ammonium chloride (TIOAH-Cl) was extracted with different extraction agents as shown in Table 8, wherein the extraction agents contain triisooctylamine as the second tertiary amine and/or butanol or xylene as the second organic solvent. Afterwards, the aqueous phase was titrated with 0.1M standard solution of sodium hydroxide to calculate the amount of triisooctyl ammonium chloride remaining in the aqueous phase and the extraction yield. The results are also shown in Table 8.

TABLE 8

| | Aqueous phase containing TIOAH-Cl | | | | | Aqueous phase after extraction | | |
|---|---|---|---|---|---|---|---|---|
| | Total amount | TIOAH-Cl | Composition of extraction agent (g) | | | Total amount | TIOAH-Cl | Extraction yield |
| Example | (g) | (mmol) | TIOA | Butanol | xylene | (g) | (mmol) | (%) |
| 8-1 | 10.02 | 3.07 | 10.02 | 0 | 0 | 6.12 | 1.29 | 58.0 |
| 8-2 | 10.05 | 3.08 | 0 | 0 | 10.01 | 9.50 | 2.72 | 11.7 |
| 8-3 | 10.01 | 3.06 | 10.01 | 10.07 | 0 | 8.49 | 0.68 | 77.8 |

As shown in Table 8, the extraction using both the second tertiary amine and the second organic solvent (Example 8-3) provides an outstanding extraction yield which is significantly better than that in the case using only an organic solvent (Example 8-2) or the second tertiary amine (Example 8-1). This indicates that the combination use of the second tertiary amine and the second organic solvent in the step (c) is necessary for the method of the present invention.

Example 9

The aqueous phase sample obtained from Example 1-2 and containing trioctyl ammonium chloride (TOAH-Cl) was extracted with different extraction agents as shown in Table 9, wherein the extraction agents contain trioctylamine (TOA) as the second tertiary amine and butanol as the second organic solvent. Afterwards, the aqueous phase was titrated with 0.1M standard solution of sodium hydroxide to calculate the amount of trioctyl ammonium chloride remaining in the aqueous phase and the extraction yield. The results are also shown in Table 9.

TABLE 9

| | Aqueous phase containing TIOAH-Cl | | | | Aqueous phase after extraction | | |
|---|---|---|---|---|---|---|---|
| | Total amount | TIOAH-Cl | Composition of extraction agent (g) | | Total amount | TIOAH-Cl | Extraction yield |
| Example | (g) | (mmol) | TOA | Butanol | (g) | (mmol) | (%) |
| 9-1 | 10.06 | 2.84 | 10.07 | 10.04 | 6.84 | 0.58 | 79.6 |
| 9-2 | 10.10 | 2.85 | 20.04 | 5.04 | 10.80 | 1.23 | 56.8 |
| 9-3 | 10.01 | 2.83 | 20.04 | 10.06 | 8.56 | 0.81 | 71.4 |
| 9-4 | 10.13 | 2.86 | 40.03 | 40.04 | 5.08 | 0.26 | 90.9 |

Example 10

40.27 g of the aqueous phase sample obtained from Example 3-1 and containing 9.31 wt % of trioctyl ammonium chloride (TOAH-Cl) was extracted with the extraction agent as shown in Table 10 (see Example 10-1). The mixture obtained from the extraction was allowed to stand and stratify to obtain 31.46 g aqueous phase. The aqueous phase was titrated with 0.1M standard solution of sodium hydroxide to calculate the remaining triisooctyl ammonium chloride in the aqueous phase and the extraction yield. The triisooctyl ammonium chloride remaining in the aqueous phase was 1.41 wt % and the extraction yield was 88.2 wt %. 12.87 g of the aqueous phase obtained after the extraction of Example 10-1 was further extracted. After the second extraction, the concentration of TOAH-Cl becomes undetectable (Example 10-2), which means that the extraction yield after the twice extractions was 98% or above. The results are shown in Table 10.

TABLE 10

| | Aqueous phase containing TOAH-Cl (A) | | | | | | Aqueous phase after extraction | | |
|---|---|---|---|---|---|---|---|---|---|
| | Total | TOAH-Cl concen- | Composition of extraction agent (g) (B) | | | Extraction weight | | TOAH-Cl concen- | Accumu-lative extraction |
| Example | amount (g) | tration (wt %) | TOA | butanol | Base oil | ratio (A)/(B) | Weight (g) | tration (wt %) | yield (%) |
| 10-1 | 40.27 | 9.31 | 40.11 | 80.14 | 20.78 | 1:3.5 | 31.46 | 1.41 | 88.2 |
| 10-2 | 12.87 | 1.41 | 13.45 | 25.99 | 7.46 | 1:3.6 | 11.58 | Not detected | >98 |

According to the results of Examples 9 and 10, the method of the present invention can remove the first tertiary ammonium chloride from the aqueous phase with an excellent extraction yield by using the second tertiary amine and the second organic solvent in step (c) of the method.

[Recovery Rate of Saccharides]

Example 11

As a continuation of Example 2-1 in which the weight of the aqueous phase after the filtration was measured to be 111.29 g with 30.23 wt % glucose, the filter cake was washed by water twice, and the washed liquid was collected, weighed and analyzed for the glucose concentration as shown in Table 11. The calculated glucose recovery rate is about 97 wt %.

TABLE 11

| | Aqueous phase after extraction | | First wash | | Second wash | | Mixed solution | |
|---|---|---|---|---|---|---|---|---|
| Example | Weight (g) | Glucose concen-tration (wt %) | Weight (g) | Glucose concen-tration (wt %) | Weight (g) | Glucose concen-tration (wt %) | Weight (g) | Glucose concen-tration (wt %) |
| 11-1 | 111.29 | 30.23 | 66.97 | 11.50 | 64.22 | 2.45 | 242.48 | 17.7 |

As can be seen from the above result, the method of the present invention can efficiently remove the metal ions of the cellulose swelling agent from the saccharide mixture solution and recover the saccharide in a high yield.

[Recovery of Tertiary Ammonium Chloride]

Example 12

20.16 g triisooctylamine was reacted with 7.43 g 36.5% hydrochloric acid, then the organic phase of triisooctyl ammonium chloride containing 5.92 wt % water was obtained, which is an example of the organic phase containing tertiary ammonium chloride after the extraction according to the method of the present invention. 23.518 g of the organic phase was added with 160.45 g xylene, and water therein was removed by distillation to obtain a mixture solution of triisooctyl ammonium chloride and xylene containing 540 ppm of water. The mixture solution was added with 119.96 g base oil, then it was put in a distillation flask and heated to be distilled under a nitrogen flow rate of 17 L/hr. 86.57 g xylene was distilled out while triisooctyl ammonium chloride gradually decomposed and hydrogen chloride was released and collected at the top of the distillation flask. When the temperature in the distillation flask reached 300° C., the distillation was terminated and the distillation flask was cooled. The remaining liquid in the distillation flask weighed 143.51 g and contained 0.052 mmol of undecomposed triisooctyl ammonium chloride. The decomposition rate of triisooctyl ammonium chloride is 98.9%.

The above result shows that the tertiary ammonium chloride can be decomposed into hydrogen chloride and tertiary amine and recycled in the optional step (d) of the present invention.

The above examples are provided for illustrating the principle and efficacy of the present invention and show the inventive features thereof rather than limiting the scope thereof. Any modifications and replacements that can be easily carried out by people skilled in this field without departing from the principle and spirit of the present invention should be covered in the scope of the present invention. Therefore, the scope of protection of the present invention is claimed in the claims as appended.

What is claimed is:

1. A method of separating a saccharide from an aqueous product solution of cellulose hydrolysis process, wherein the aqueous product solution comprises a saccharide and a cellulose swelling agent, and the cellulose swelling agent is zinc chloride, magnesium chloride or a combination thereof, and the method comprises the following steps in the given order:

(a) adding a first tertiary amine and an optional first organic solvent to the aqueous product solution to provide a mixture;

(b) performing a solid-liquid separation to obtain a solution from the mixture; and (c) performing a liquid-liquid extraction by adding a second tertiary amine and a second organic solvent to the solution to obtain an organic phase and an aqueous phase, and then removing the organic phase and collecting the aqueous phase, wherein the first tertiary amine and the second tertiary amine are the same or different, and the first organic solvent and the second organic solvent are the same or different, wherein the first tertiary amine and the second tertiary amine are independently represented by a formula of $NR_1R_2R_3$, wherein each of $R_1$, $R_2$, and $R_3$ is independently C4-C10 alkyl.

2. The method according to claim 1, wherein the first tertiary amine and the second tertiary amine are independently selected from the group consisting of N-methyldicyclohexylamine, tributylamine, tripentylamine, tri-n-octylamine, tri-isooctylamine, and combinations thereof.

3. The method according to claim 2, wherein in the step (a), the amount of the first organic solvent is 0 to 3.5 parts by weight per part by weight of the first tertiary amine.

4. The method according to claim 2, wherein in the step (c), the amount of the second tertiary amine is 0.1 to 10 parts by weight per part by weight of the second organic solvent.

5. The method according to claim 2, which further comprises at least one of the following steps:

(d) heating the organic phase removed in the step (c) to recycle the first tertiary amine and the second tertiary amine and obtain hydrochloride; and (e) washing a solid fraction separated in the step (b) with water, and mixing the washed solid fraction with an aqueous solution of hydrochloride to recycle the cellulose swelling agent.

6. The method according to claim 2, which further comprises a step of removing the organic phase from the mixture before the step (b), or a step of removing the organic phase from the solution before the step (c).

7. The method according to claim 1, wherein the first organic solvent and the second organic solvent are independently selected from the group consisting of primary alcohols, ketones, C6 or heavier alkanes, chloroalkanes, benzene and its derivatives, and combinations thereof.

8. The method according to claim 1, wherein the first organic solvent and the second organic solvent are independently a primary alcohol selected from the group consisting of n-butanol, n-pentanol, n-hexanol, cyclohexanol, n-heptanol, n-octanol, the isomers thereof, and combinations thereof.

9. The method according to Claim 1, wherein the first organic solvent and the second organic solvent are independently a ketone selected from the group consisting of butanone, pentanone, hexanone, cyclohexanone, the isomers thereof, and combinations thereof.

10. The method according to Claim 1, wherein the first organic solvent and the second organic solvent are independently selected from the group consisting of chloromethane, dichloromethane, trichloromethane, 1, 1-dichloroethane, 1 ,2-dichloroethane, and combinations thereof.

11. The method according to claim 1, wherein in the step (a), the amount of the first organic solvent is 0 to 3.5 parts by weight per part by weight of the first tertiary amine.

12. The method according to claim 1, wherein in the step (c), the amount of the second tertiary amine is 0.1 to 10 parts by weight per part by weight of the second organic solvent.

13. The method according to claim 1, which further comprises at least one of the following steps:

(d) heating the organic phase removed in the step (c) to recycle the first tertiary amine and the second tertiary amine and obtain hydrochloride; and (e) washing a solid fraction separated in the step (b) with water, and mixing the washed solid fraction with an aqueous solution of hydrochloride to recycle the cellulose swelling agent.

14. The method according to claim 13, which further comprises a step of removing the organic phase from the mixture before the step (b), or a step of removing the organic phase from the solution before the step (c).

15. The method according to claim 1, which further comprises a step of removing the organic phase from the mixture before the step (b), or a step of removing the organic phase from the solution before the step (c).

* * * * *